US008166669B2

(12) United States Patent
Park et al.

(10) Patent No.: US 8,166,669 B2
(45) Date of Patent: May 1, 2012

(54) LAUNDRY MACHINE AND A METHOD FOR OPERATING THE SAME

(75) Inventors: Seog Kyu Park, Changwon-si (KR); Kwang Cheol Park, Busan (KR)

(73) Assignee: LG Electronics Inc., Seoul (KR)

( * ) Notice: Subject to any disclaimer, the term of this patent is extended or adjusted under 35 U.S.C. 154(b) by 1072 days.

(21) Appl. No.: 11/791,119

(22) PCT Filed: May 24, 2006

(86) PCT No.: PCT/KR2006/001954
§ 371 (c)(1),
(2), (4) Date: Mar. 10, 2008

(87) PCT Pub. No.: WO2007/024056
PCT Pub. Date: Mar. 1, 2007

(65) Prior Publication Data

US 2008/0209757 A1 Sep. 4, 2008

(30) Foreign Application Priority Data

Aug. 25, 2005 (KR) ..... 10-2005-0078193

(51) Int. Cl.
*F26B 7/00* (2006.01)

(52) U.S. Cl. ..... 34/399; 34/524; 34/601; 34/610; 134/10; 134/30; 68/5 C; 68/20; 8/137

(58) Field of Classification Search ..... 34/399, 34/524, 90, 104, 72, 601, 610; 134/10, 30; 68/5 C, 20; 8/137
See application file for complete search history.

(56) References Cited

U.S. PATENT DOCUMENTS

| | | | | |
|---|---|---|---|---|
| 5,477,623 | A * | 12/1995 | Tomizawa et al. | 34/58 |
| 7,665,227 | B2 * | 2/2010 | Wright et al. | 34/339 |
| 7,921,578 | B2 * | 4/2011 | McAllister et al. | 34/597 |
| 7,930,838 | B2 * | 4/2011 | Bae et al. | 34/597 |
| 2005/0016012 | A1 | 1/2005 | Yang et al. | |
| 2008/0115381 | A1 * | 5/2008 | Bae et al. | 34/60 |
| 2008/0209757 | A1 * | 9/2008 | Park et al. | 34/389 |
| 2009/0172967 | A1 * | 7/2009 | Son et al. | 34/318 |
| 2009/0235553 | A1 * | 9/2009 | Bae et al. | 34/524 |
| 2009/0249639 | A1 * | 10/2009 | Kim et al. | 34/389 |
| 2009/0255299 | A1 * | 10/2009 | Hiro et al. | 68/19 |
| 2010/0011608 | A1 * | 1/2010 | Grunert et al. | 34/85 |
| 2010/0011609 | A1 * | 1/2010 | Park et al. | 34/88 |
| 2011/0041562 | A1 * | 2/2011 | Balinski et al. | 68/20 |

FOREIGN PATENT DOCUMENTS

| | | | |
|---|---|---|---|
| DE | 600 17 542 | T2 | 3/2006 |
| DE | 102 60 151 | A1 | 7/2007 |
| EP | 39645 | A1 * | 11/1981 |
| JP | 02057300 | A * | 2/1990 |
| JP | 04200591 | A * | 7/1992 |
| JP | 8168594 | | 7/1996 |
| KR | 10-2005-0074572 | | 7/2005 |
| WO | WO 2004/059070 | A1 | 7/2004 |
| WO | WO 2007024056 | A1 * | 3/2007 |

* cited by examiner

*Primary Examiner* — Stephen M. Gravini
(74) *Attorney, Agent, or Firm* — McKenna Long & Aldridge LLP

(57) ABSTRACT

The present invention relates to a laundry machine and a method for operating the same for removing wrinkles or the like from laundry by using high temperature and high humidity air instead of steam. The method for operating a laundry machine includes the steps of a course selecting step for selecting an operating course, and a high temperature and high humidity air supply step for supplying high temperature high humidity air to a drum from an air supply unit.

10 Claims, 3 Drawing Sheets

[Fig. 1]
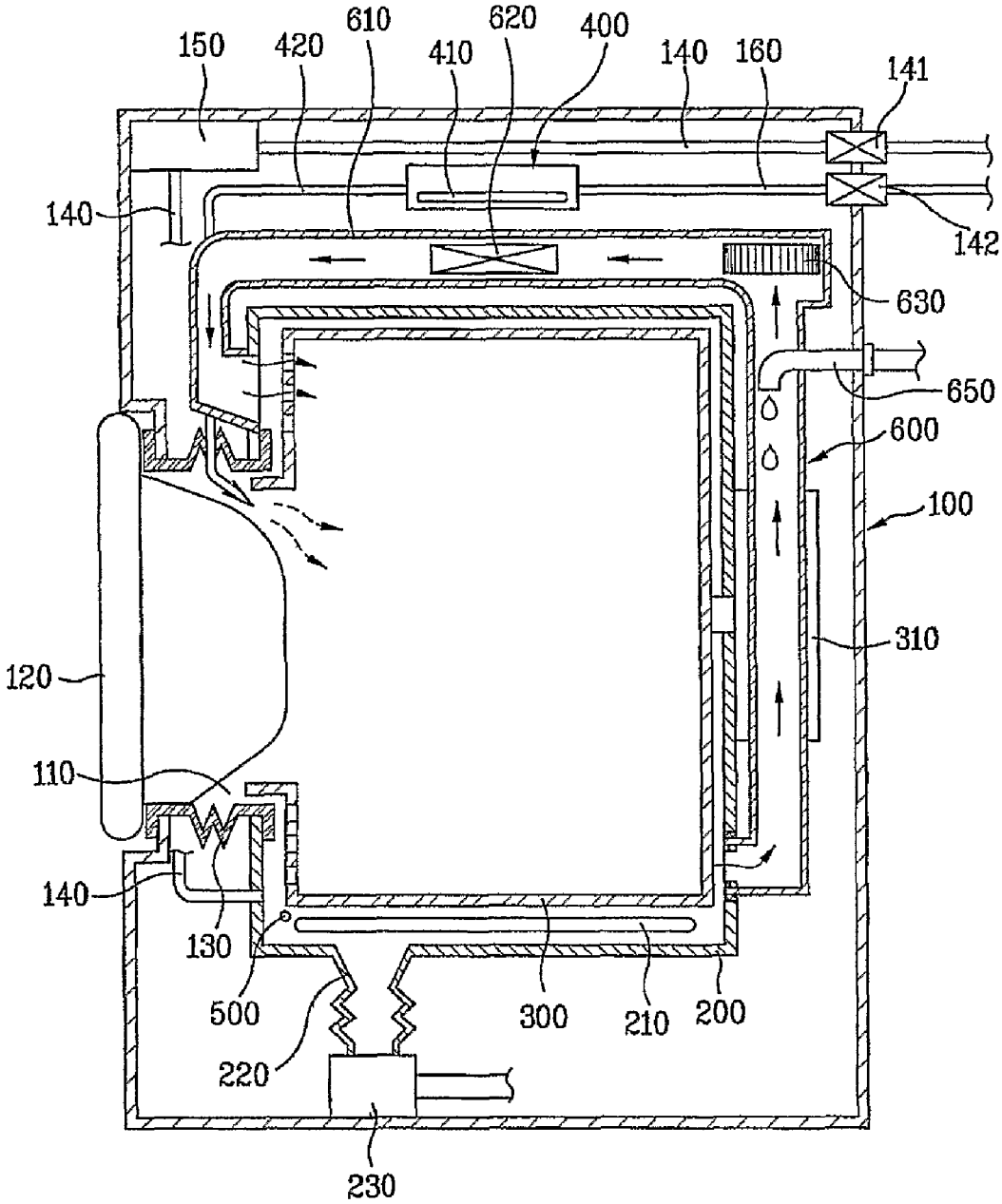

[Fig. 2]
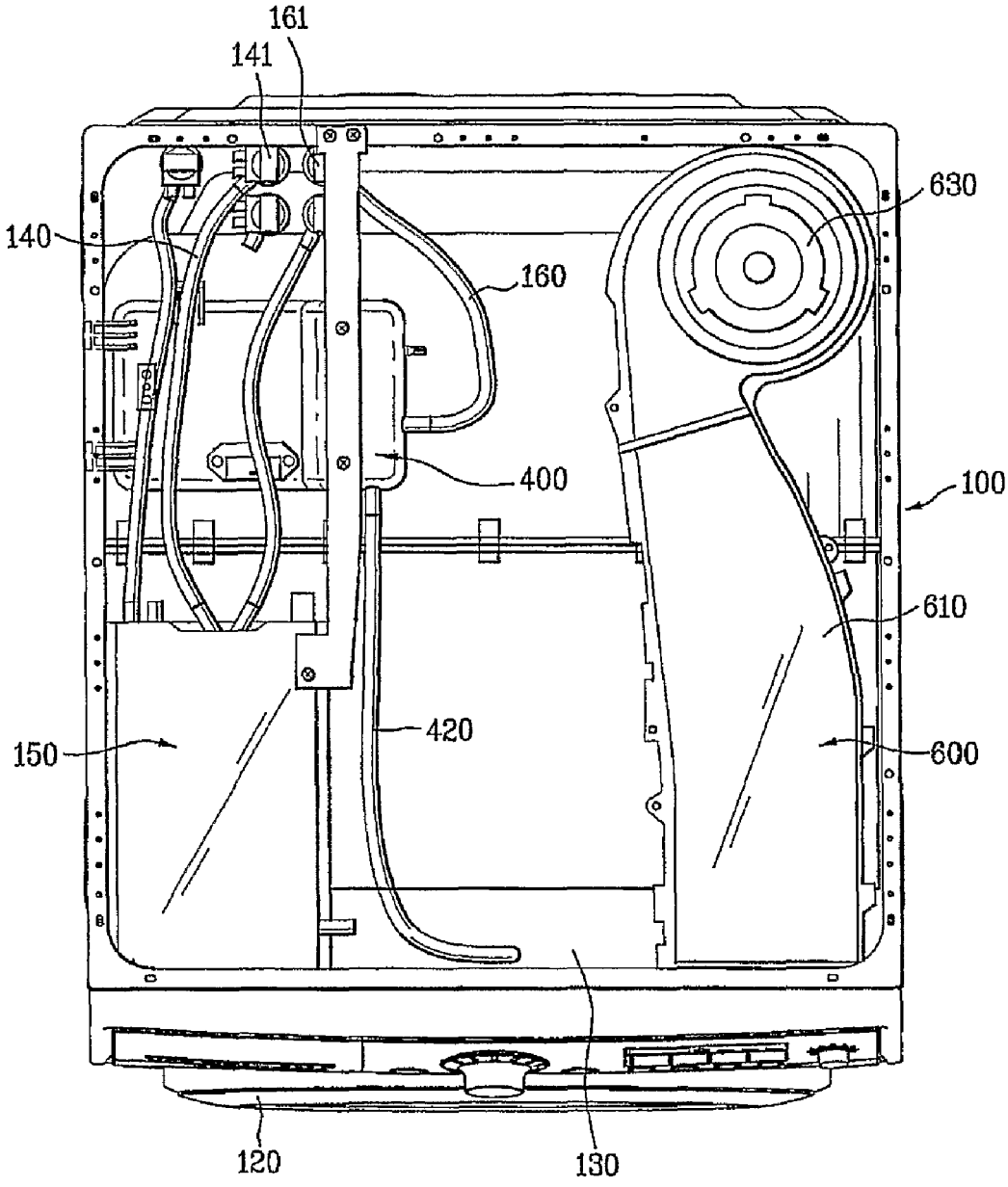

[Fig. 3]
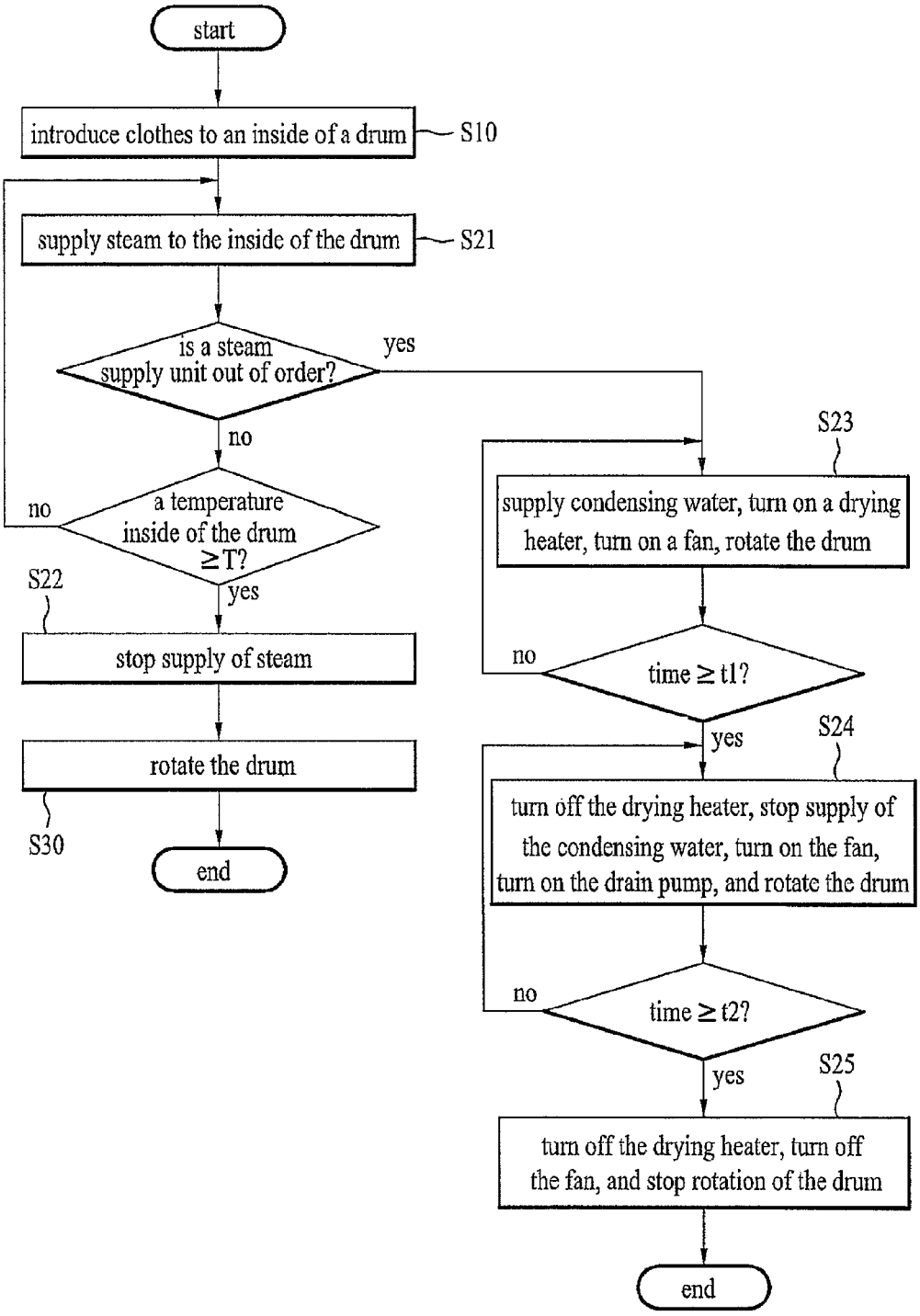

LAUNDRY MACHINE AND A METHOD FOR OPERATING THE SAME

This application claims priority to International application No. PCT/KR2006/001954 filed on May 24, 2006, and Korean Application No. 10-2005-0078193 filed on Aug. 25, 2005, all of which are incorporated by reference, as if fully set forth herein.

TECHNICAL FIELD

The present invention relates to a laundry machine and a method for operating the same for removing wrinkles or the like from laundry by using high temperature and high humidity air instead of steam, and more particularly, to a laundry machine which can supply high temperature and high humidity air instead of steam in a case the steam can not be supplied due to an error or the like, such as out of order of a steam generator.

BACKGROUND ART

In general, in the laundry machines, there are pulsator type washing machines each having an upright drum, drum type washing machines each having a horizontally laid down drum, drying and washing machines each having a drying function, and laundry dryers only for drying laundry.

Of the laundry machines, in general, the drying and washing machines and the laundry dryers have hot air supplied to the drum for drying wet laundry.

However, despite of many wrinkles on the laundry dried by the related art the drying and washing machine or the laundry dryer, the related art the drying and washing machine or the laundry dryer is not provided with a separate structure or operation for removing the wrinkles.

Particularly, the related art the drying and washing machine or the laundry dryer can not remove wrinkles from dried laundry.

Due to this, there has been inconvenience in that the user can put on dried clothes only when the user presses out the dried clothes by using a separate iron.

DISCLOSURE OF INVENTION

Technical Problem

The present invention is devised for solving the foregoing various problems in the related art. An object of the present invention is to supply high temperature and high humidity air to a drum for removing wrinkles from laundry or the like.

Along with this, in a case steam can not be supplied from a steam supply unit, to fail in removal of wrinkles by using steam, not steam, but high temperature and high humidity air is supplied not from the steam supply unit, but from an air supply unit, to enable to remove the wrinkles.

Technical Solution

The object of the present invention can be solved by providing a method for operating a laundry machine including a course selecting step for selecting an operating course, and a high temperature and high humidity air supply step for supplying high temperature high humidity air to a drum from an air supply unit.

The high temperature and high humidity air supply step includes a moisture supplying step for supplying moisture to air in the air supply unit, and a step for heating the air with a heater the air supply unit and supplying the air to the drum with a fan of the air supply unit.

The moisture supplying step includes the step of humidifying air in the duct of the air supply unit. A humidifier, such as an ultrasonic humidifier may be used for humidifying the air in the duct. Or, by supplying water to the duct simply, the air in the duct can be humidified as the water is vaporized. In a case water is supplied to the duct, it is preferable that a step for draining the water from the duct may be included if required.

Preferably, the high temperature and high humidity supply step is performed in a case the steam supply unit can not supply steam to the drum.

The high temperature and high humidity air supply step is performed when the steam supply unit can not supply steam due to out of order of the steam supply unit even if an operating course which requires supply of steam to the drum is selected. Then, the high temperature and high-humidity air is supplied to the drum as a substitute of the steam. The supply of steam to the drum provides effects of sterilizing, deodoring, and so on, besides an effect of wrinkle removal from clothes.

It is preferable that the high temperature and high humidity air supply step includes the step of controlling the drum to rotate. The rotation of the drum makes the clothes to move, enabling the high temperature and high humidity steam being brought into better contact with the clothes.

It is preferable that the method further includes a low temperature air supply step for supplying low temperature air to an inside of the drum after finish of the high temperature and high humidity air supply step. It is preferable that the low temperature air is air with a low humidity.

It is required to cool down the inside of the drum with the low temperature air because the temperature inside of the drum can be at a high temperature due to the high temperature and high humidity air. The supply of the low temperature and low humidity air is preferable since the supply of the low temperature and low humidity air also performs drying of the clothes. It is preferable that the low temperature air supply step includes the step of controlling the drum to rotate.

The high temperature and high humidity air supply step or the low temperature air supply step is performed for a time period varied with an amount of object in the drum, such as clothes.

The high temperature and high humidity air supply step or the low temperature air supply step way be controlled according to a temperature in the drum. For an example, the high temperature and high humidity air may be supplied intermittently for maintaining the temperature inside of the drum constant, substantially. That is, supply and stop may be repeated. The low temperature air supply step may be controlled such that the low temperature air is supplied until the temperature inside of the drum drops below a preset temperature.

In the meantime, in another aspect of the present invention, a laundry machine includes course selection means for selecting a course, an air supply unit for supplying high temperature high humidity air to a drum, and a controller for controlling the air supply unit to supply the high temperature high humidity air to the drum.

Preferably, the laundry machine further includes a steam supply unit for supplying steam to the drum.

More preferably, the controller controls the air supply unit such that the air supply unit supplies the high temperature and high humidity air to the drum in a case the steam supply unit can not supply the steam to the drum.

For an example, if the steam supply unit is out of order, the steam supply unit has shortage of water, steam supply from the steam supply unit requires a long time, or so on, the high temperature and high humidity air is supplied from the air supply unit.

Advantageous Effects

By supplying high temperature and high humidity air to the inside of the drum instead of the steam, wrinkles can be removed from clothes.

Along with this, if the removal of wrinkles with the steam is not possible due to the steam can not be supplied from the steam supply unit, not the steam, but the high temperature high humidity air is supplied, not from the steam supply unit, but from the air supply unit, to remove the wrinkles.

BRIEF DESCRIPTION OF THE DRAWINGS

FIG. 1 illustrates a section of one example of a laundry machine having a method of the present invention applicable thereto;

FIG. 2 illustrates a plan view for explaining an internal structure of the laundry machine in FIG. 1; and FIG. 3 illustrates a flow chart showing the steps of a method for operating a wrinkle removing course of a laundry machine in accordance with a preferred embodiment of the present invention.

BEST MODE FOR CARRYING OUT THE INVENTION

Before starting description of embodiments of the present invention, a laundry machine set forth in the description of embodiments of the present invention is a drying and washing machine. Of course, the laundry machine may be an exclusive washing machine, or a laundry dryer only for drying laundry.

Referring to FIGS. 1 and 2, the laundry machine in accordance with a preferred embodiment of the present invention includes a body 100, a tub 200, a drum 300, a steam supply unit 400, a temperature sensor 500, and an air supply unit 600.

The body 100 forms an exterior of the laundry machine, with a laundry opening 110 in a front.

There is a door 120 on the laundry opening of the body 100 for opening/closing the laundry opening 110, with a rim portion 130 along an inside circumference of the laundry opening 110 for sealing between the door 120 and the laundry opening 110.

The body 100 also has a washing water supply pipe 140 for supplying washing water to the tub 200.

The washing water supply pipe 140 is connected to an inside of the tub 200 so as to be in communication therewith through a detergent box 150 in the body 100.

The tub 200 is suspended in the body 100.

At a lower portion of the tub 200, there is a washing water heater 210 for heating the washing water supplied to the tub 200.

Connected to an underside of the tub 200, there is a drain flow line 220 for draining the washing water.

Mounted on the drain flow line 220, there is a drain pump 230 for forced draining of the washing water.

The drum 300 is rotatably mounted in the tub 200, with a side having an opening positioned to face the laundry opening of the body 100.

Coupled to a rear of the drum 300, there is a driving unit 310 for rotating the drum 300.

There is at least one steam supply unit 400 for supplying a predetermined amount of steam to an inside of the drum 300 (or tub). An example for mounting the steam supply unit 400 is illustrated in detail in FIG. 2 attached hereto.

The steam supply unit 400 includes a steam generator 410 for heating water held therein to generate steam, and a steam supply pipe 420 for guiding flow of the steam generated thus.

It is preferable that a steam outlet of the steam supply pipe 420 is passed through the rim portion 130 for directing toward the inside of the drum 300.

The temperature sensor 500 senses a temperature of an inside of the tub 200.

It is preferable that the temperature sensor is provided in a space of the tub 200. The temperature to be sensed by the temperature sensor 500 is used for controlling operation of the steam supply unit 400 and the air supply unit 600.

The air supply unit 600 is used for drying the laundry and removal of wrinkles, and designed to supply hot air or cold air to the inside of the drum 300.

The air supply unit 600 includes a drying duct 610, a drying heater 620, a fan 630, a fan motor (not shown), and a condensing water supply pipe 650.

The drying duct 610 has both ends in communication with the inside of the tub 200. In this instance, it is preferable that one end of the drying duct 610 is connected to rear of the tub 200, and the other end of the drying duct 610 is connected to a front side of the tub 200. Of course, the drying duct 610 may be mounted such that one end thereof is in communication with the tub 200, and the other end thereof is in communication with an outside of the body 100.

The drying heater 620 is in the drying duct 610, for heating air in the drying duct 610 to generate hot air.

The fan 630 and the motor are in the drying duct 610, for supplying air from the drying duct 300 to the drum 300 through the drying heater 620.

The condensing water supply pipe 650 supplies cold condensing water to the drying duct 610, for removing moisture from humid air discharged from the drum 300.

In the meantime, an unexplained reference symbol 160 denotes a steam water supply pipe for supplying water to the steam supply unit 400.

Unexplained reference symbols 141 and 161 are shut off valves on pipe lines of the washing water supply pipe 140 and the steam water supply pipe 160, respectively.

An operating method for removing wrinkles by using the foregoing laundry machine in accordance with a preferred embodiment of the present invention will be described with reference to the attached flow chart in FIG. 3.

Before starting operation of the laundry machine for removing wrinkles (hereafter called as "wrinkle removing course"), a step for introducing a wrinkle removing object (hereafter called as "clothes") into the inside of the drum 300 is performed (S10).

Even through the object of the wrinkle removing course is clothes in a dried state with wrinkles, the object may be clothes containing a small amount of moisture after finish of spinning.

If introduction of the clothes is finished, the controller (not shown) controls the steam supply unit 400 to start a step for supplying high temperature steam to the drum 300 (S21).

That is, after generating steam by supplying steam water to the steam generator 410, and heating the steam water, the steam generated thus is supplied to the drum 300.

The steam is used to make the clothes to contain a small amount of moisture so that the clothes is in a state the wrinkles can be removed from the clothes, smoothly. Particularly, because the steam is at a high temperature, the removal of the wrinkles can be smoother.

The steam generated at the steam generator 410 is sprayed into the drum 300 through the steam supply pipe 420. It is preferable that the driving unit 310 is controlled to rotate the drum 300 for smoother supply of the steam to the clothes while the steam is supplied to the drum 300.

Particularly, it is preferable that, by controlling the drum 300 to rotate, not in one direction, but both directions, entangling of pieces of clothes in the drum 300 is prevented, and the steam can be supplied throughout the pieces of the clothes, more uniformly.

As described before, the steam is supplied to the inside of the drum 300 until the temperature inside of the drum 300 reaches to a preset temperature.

The preset temperature is a temperature higher than 40° C. Such a reference of the temperature is set because an environment of the inside of the drum 30 the most effective for the removal of the wrinkles is a temperature higher than 40° C.

Of course, the higher the temperature, the smoother the removal of the wrinkles from the clothes. However, if the temperature inside of the drum 300 is too high, not only a problem can be caused, in which the clothes is damaged, or deformed, but also a problem can be caused, in which the clothes is liable to wet with a large amount of steam.

Therefore, it is preferable that the preset temperature falls on a temperature between 40° C. ~60° C. at which the wrinkle removing performance is good and the damage to the clothes is prevented.

If the temperature inside of the drum 300 reaches to the preset temperature by above steps, the steam supply unit 400 is controlled to stop the steam supply (S22).

Then, the wrinkle removing process is kept on while rotating the drum 300 for a preset time period in a state supply of the steam is stopped (S30).

In a case the steam supply unit 400 is operative normally, by supplying the steam to an inside of the drum, the wrinkles are removed.

However, if the steam supply unit 400 is out of order, unable to supply the steam, a hot air supply step S23 in which high temperature humid air is supplied with the air supply unit 600 and a cold air supply step S24 are performed in succession to remove the wrinkles.

This will be described in more detail.

If the controller senses that the steam supply unit 400 is out of order, the controller supplies the condensing water to an inside of the drying duct 610 through the condensing water supply pipe 650. The condensing water supplied thus is held on a lower portion of the drying duct 610.

Then, the drying heater 620 and the fan 630 are operated, to generate hot air at the drying duct 610. The hot air flowing through the drying duct 610 becomes to contain moisture as the hot air passes through the condensing water held at the lower portion of the drying duct 610, and serves as steam as the hot air is introduced into the drum 300. That is, the hot air removes wrinkles from the clothes.

In this instance, the drying heater 620 is turned on/off according to the temperature in the drum measured by the temperature sensor 500, to maintain the inside of the drum 300 to be within a predetermined temperature range.

For an example, the drying heater 620 is turned on below a drum inside temperature $T_L$ to generate heat, and turned off over a temperature $T_H$, to stop the generation of heat. It is preferable that a range of temperature control ($T_L$~$T_H$) by the drying heater is lower than a range of temperature control by the drying heater at the time of a general drying cycle in a laundry machine (for an example, a drying cycle coming after washing and spinning in a drum type washing machine). Because the moisture contained in the wrinkle removing object is smaller than the moisture contained in the drying object in the general drying cycle, the supply of hot air with a too high temperature to the wrinkle removing object is liable to cause damage to the clothes.

It is preferable that the drum is rotated so that the hot air supplied to the inside of the drum 300 gives influences to the clothes uniformly at the time the humid hot air is supplied through the drying duct 610. It is more preferable that the drum 300 is rotated in both directions alternately for preventing the clothes from entangling and the hot air gives influence to the clothes uniformly. Or, alternatively, the drum may be controlled to repeat rotation and stop at fixed intervals.

It is preferable that the operation time is set to be before starting of the operation for refreshing, i.e., before supply of steam to the drum 300.

The supply of hot, and humid air by using the air supply unit 600 is performed for a present time period t1. It is preferable that the preset time period t1 varies with an amount of clothes, i.e., laundry amount, introduced into the drum 300. That is, it is preferable that, if the laundry amount is small, the operation time period is set to be short, and if the laundry amount is large, the operation time period is set to be long.

Upon finishing the hot air supply step S23, the drain pump 230 is put into operation, to discharge the condensing water held on the lower portion of the drying duct 610 to an outside of the laundry machine.

Because the inside of the drum 300 is at a substantially high temperature right after the removal of the wrinkles from the clothes by supplying the hot, humid air to the inside of the drum, taking cut the clothes from the drum 300 right after finish of the removal of the wrinkles is dangerous, and wearing of the clothes right after finish of the removal of the wrinkles is improper.

Therefore, upon finish of the hot air supply step S23, the drying heater 620 is turned off, and the fan 630 is kept to run, to perform the cold air supply step S50 for a pre-determined time period t2 for supplying low temperature air to the inside of the drum.

As described before, though the cold air supply step S50 is controlled to be kept on for the predetermined time period t2, different from this, the cold air supply step S50 may be controlled to be performed until the temperature inside of the drum 300 drops below a predetermined temperature.

It is more preferable that the temperature inside of the drum 300 drops more smoothly by controlling the drum 300 to be rotated during the cold air supply step S50 is performed.

By stopping rotation of the drum 300 as well as the rotation of the fan 630 if the cold air supply step S50 passes a preset time period t2, or the temperature inside of the drum 300 reaches to a preset temperature, an entire wrinkle removing course is finished.

Upon finish of the wrinkle removing course in a case the steam supply unit is cut of order, the user inspect and repairs the steam supply unit of the laundry machine.

In the meantime, in the foregoing embodiment of the method for operating the laundry machine, humid hot air is generated by supplying the condensing water to the inside of the drying duct 610 and putting the drying heater 620 into operation when the steam supply unit 400 is cut of order. However, different from this, by supplying a small amount of water to the inside of the tub 200 by using a water supply system, such as the washing water supply pipe 620, or the like, and supplying hot air to the inside of the drum through the air supply unit 600, to make the inside of the drum to be very humid and hot, the wrinkle removing effect of the steam may be obtained.

INDUSTRIAL APPLICABILITY

The present invention relates to a laundry machine and a method for operating the same for removing wrinkles or the like from laundry by using high temperature and high humidity air instead of steam, and more particularly, to a laundry machine which can supply high temperature and high humidity air instead of steam in a case the steam can not be supplied due to an error or the like, such as out of order of a steam generator.

By supplying high temperature and high humidity air to the inside of the drum instead of the steam, wrinkles can be removed from clothes.

Along with this, if the removal of wrinkles with the steam is not possible due to the steam can not be supplied from the steam supply unit, not the steam, but the high temperature high humidity air is supplied, not from the steam supply unit, but from the air supply unit, to remove the wrinkles.

The invention claimed is:

1. A method for operating a laundry machine, comprising:

a course selecting step for an operating course being selected; and a high temperature and high humidity air supply step for supplying high temperature and high humidity air to a drum from an air supply unit, wherein the high temperature and high humidity air supply step includes:

a moisture supplying step for supplying moisture to air in the air supply unit, and a step for heating the air with a heater of the air supply unit and supplying the air to the drum with a fan of the air supply unit, wherein the moisture supplying step includes:

a step of supplying water to an inside of a duct of the air supply unit, and a step of the air passing through the water inside of the duct.

2. The method as claimed in claim 1, wherein the operating course is a course in which supply of steam to the drum is required, and the high temperature and high humidity air supply step is performed when the steam supply unit is out of order.

3. The method as claimed in claim 2, wherein the high temperature and high humidity air supply step includes a step of controlling the drum to rotate.

4. The method as claimed in claim 2, further comprising:

a low temperature air supply step for supplying low temperature air to an inside of the drum after finish of the high temperature and high humidity air supply step.

5. The method as claimed in claim 4, wherein the low temperature air supply step includes a step of controlling the drum to rotate.

6. The method as claimed in claim 4, wherein the high temperature and high humidity air supply step or the low temperature air supply step is performed for a time period varied with an amount of object in the drum.

7. The method as claimed in claim 4, wherein the high temperature and high humidity air supply step or the low temperature air supply step is controlled according to a temperature in the drum.

8. The method as claimed in claim 1, further comprising:

a step of draining water supplied to the duct.

9. A laundry machine, comprising:

course selection means for a course being selected;

an air supply unit for supplying high temperature high humidity air to a drum;

a steam supply unit for supplying steam to the drum; and a controller for controlling the air supply unit to supply the high temperature and high humidity air to the drum, wherein the controller controls the air supply unit such that the air supply unit supplies the high temperature and high humidity air to the drum in a case the steam supply unit cannot supply the steam to the drum.

10. The laundry machine as claimed in claim 9, further comprising:

a water supply pipe supplying water to a duct of the air supply unit.

* * * * *